US009551354B2

(12) United States Patent
Lee et al.

(10) Patent No.: US 9,551,354 B2
(45) Date of Patent: Jan. 24, 2017

(54) REGENERATIVE-TYPE FLUID MACHINERY HAVING A GUIDE VANE ON A CHANNEL WALL

(75) Inventors: Kyoung Yong Lee, Chungcheongnam-do (KR); Young Seok Choi, Gyeonggi-do (KR)

(73) Assignee: KOREA INSTITUTE OF INDUSTRIAL TECHNOLOGY (KR)

( * ) Notice: Subject to any disclaimer, the term of this patent is extended or adjusted under 35 U.S.C. 154(b) by 523 days.

(21) Appl. No.: 14/119,697

(22) PCT Filed: May 9, 2012

(86) PCT No.: PCT/KR2012/003630

§ 371 (c)(1), (2), (4) Date: Nov. 22, 2013

(87) PCT Pub. No.: WO2012/161436

PCT Pub. Date: Nov. 29, 2012

(65) Prior Publication Data

US 2014/0079543 A1 Mar. 20, 2014

(30) Foreign Application Priority Data

May 23, 2011 (KR) ..... 10-2011-0048611

(51) Int. Cl.
*F04D 5/00* (2006.01)
*F04D 29/44* (2006.01)

(52) U.S. Cl.
CPC ..... *F04D 29/44* (2013.01); *F04D 5/008* (2013.01)

(58) Field of Classification Search
CPC ..... F04D 23/00; F04D 23/008; F04D 5/002; F04D 5/008; F04D 29/40; F04D 29/403; F04D 29/406

(Continued)

(56) References Cited

U.S. PATENT DOCUMENTS 2,045,851 A * 6/1936 Hamilton ..... F04D 5/002 415/170.1
2,807,217 A * 9/1957 Krzyszczuk ..... F04D 23/008 415/185

(Continued)

FOREIGN PATENT DOCUMENTS

JP 57137690 A 8/1982
JP 60184993 A 9/1985

(Continued)

OTHER PUBLICATIONS

International Search Report in connection with PCT/KR2012/003630 dated Nov. 23, 2012.

*Primary Examiner* — Richard Edgar
(74) *Attorney, Agent, or Firm* — Levenfeld Pearlstein, LLC

(57) ABSTRACT

A regenerative fluid machine having guide vanes on a flow channel wall is disclosed. The regenerative fluid machine includes a circular plate-shaped impeller having a plurality of vanes radially formed on an outer circumference thereof at regular intervals, casings in which the impeller is housed, and flow channels, each of which has a suction hole and a discharge hole in opposite ends thereof, and which are circumferentially disposed within the casings so as to face the vanes. The plurality of guide vanes having an inclined angle (θ) with respect to a radial direction protrude from the flow channel wall in a rotational direction of the impeller so that a relative inflow angle (β) of the fluid introduced into the impeller grooves is increased and thus an absolute inflow angle (α) is decreased.

3 Claims, 9 Drawing Sheets

(58) Field of Classification Search
USPC ..... 415/55.1, 55.2, 55.3
See application file for complete search history.

(56) References Cited

U.S. PATENT DOCUMENTS

| | | | | | |
|---|---|---|---|---|---|
| 4,376,613 | A | * | 3/1983 | Schoenwald | F04D 23/008 415/119 |
| 4,500,253 | A | * | 2/1985 | Haberl | F04D 5/002 415/55.2 |

FOREIGN PATENT DOCUMENTS

| | | | |
|---|---|---|---|
| JP | 2005188425 | A | 7/2005 |
| KR | 200205506 | Y1 | 12/2000 |
| KR | 200301847 | Y1 | 1/2003 |

* cited by examiner

REGENERATIVE-TYPE FLUID MACHINERY HAVING A GUIDE VANE ON A CHANNEL WALL

CROSS-REFERENCE TO RELATED APPLICATIONS

This is a National Stage Application of International Patent Application No. PCT/KR2012/003630, filed Sep. 5, 2012, which claims the benefit of and priority to Korean Patent Application No. 10-2011-0048611, filed May 23, 2011, the contents of which are incorporated fully by reference herein.

TECHNICAL FIELD

The present invention relates, in general, to a regenerative fluid machine and, more particularly, to a regenerative fluid machine having guide vanes on a flow channel wall, in which the guide vanes for guiding a flow of a fluid protrude from the flow channel wall so as to change an inflow angle of the fluid introduced into impeller grooves, thereby reducing energy loss caused by eddies generated within the impeller grooves.

BACKGROUND ART

Generally, regenerative fluid machines have a simpler structure than typical centrifugal or axial-flow fluid machines, and have excellent durability as well as features appropriate to obtain a large head at a relatively small flow rate. Such regenerative fluid machines have been applied to vehicle fuel pumps, industrial high-pressure air blowers, or air blowers for fuel cells that requires high pressure, and research on decreasing size and increasing pumping efficiency has been conducted. In particular, regenerative fluid machines are known as ring blowers in the air blower field, and problems of such a conventional ring blower will be described.

FIG. 1 is an exploded perspective view illustrating an example of a conventional ring blower, and FIG. 2 is a cross-sectional view illustrating an assembled state of FIG. 1. As illustrated in FIGS. 1 and 2, a conventional ring blower has a structure in which a circular plate-shaped impeller 10 is installed in a pair of casings 20. The impeller 10 has a plurality of vanes 12 that are radially formed on outer circumferences of both faces thereof at regular intervals, and impeller grooves 14 are formed between the vanes 12. The impeller 10 is rotatably driven by a motor (not shown).

Further, ring-shaped flow channels 30 facing the impeller grooves 14 are provided inside the pair of casings 20, respectively. Each of the flow channels 30 forms a separate flow field. Alternatively, there is also a structure in which the impeller grooves 14 are formed only in one face of the impeller 10, and thus one flow channel 30 is provided. Furthermore, both ends of each flow channel 30 are provided with a suction hole 32 and a discharge hole 34.

In the ring blower having such a configuration, as the impeller 10 rotates, a gas is introduced through the suction holes 32 of the flow channels 30, and a high-pressure gas which circulates between the impeller grooves 14 and the flow channels 30 to accumulate energy is discharged through the discharge holes 34.

In order to improve performance of the regenerative fluid machine such as the ring blower, it is necessary to accurately understand a flow characteristic of the fluid to prevent pumping efficiency from being degraded due to energy loss.

To this end, the concept of a relative velocity will be introduced, and the flow characteristic in the regenerative fluid machine will be examined.

FIG. 3 is a diagram for describing a flow characteristic of a fluid in flow channels and impeller grooves. A plurality of small arrows shown in FIG. 3 represent velocity vectors according to a flow of the fluid. Thus, as the impeller 10 rotates clockwise, a circulation flow is shown in which the fluid is introduced from the flow channels 30 into the impeller grooves 14, flows outside the impeller grooves 14, and returns to the flow channels 30 again. Such a circulation flow is repeatedly formed in the plurality of impeller grooves 14 and the flow channels 30, thereby increasing pressure of the fluid.

A large arrow shown in FIG. 3 briefly illustrates the circulation flow obtained by introducing the concept of the relative velocity. A symbol Va represents an absolute velocity of the fluid that is introduced from the flow channels 30 into the impeller grooves 14, and a symbol Vb represents a velocity of the impeller 10 that rotates clockwise. Furthermore, a symbol Vc represents a relative velocity of the fluid that is introduced into the impeller grooves 14 and on which relative rotation of the impeller 10 is reflected. In this case, the absolute velocity Va and the relative velocity Vc of the fluid have an absolute inflow angle $\alpha$ and a relative inflow angle $\beta$ with respect to the velocity Vb of the impeller 10.

Meanwhile, as in FIG. 3, the relative inflow angle $\beta$ of the fluid has a different vane angle than the impeller vanes 12. As such, this difference generates eddies in the impeller grooves 14. Accordingly, there is a problem in that energy loss caused by the eddies remarkably reduces the pumping efficiency of the regenerative fluid machine. In this case, it can be seen that, as the difference between the relative inflow angle $\beta$ at which the fluid is introduced into the impeller grooves 14 and the vane angle of the vanes 12 increases, the energy loss caused by the eddies becomes greater.

Accordingly, the fluid is introduced into the impeller grooves 14 in a state in which the relative inflow angle $\beta$ of the fluid is increased, in other words, in which a direction of the relative velocity Vc of the fluid is set to be parallel to the vanes 12. Thereby, the generation of the eddies can be minimized, and performance of the regenerative fluid machine can be improved.

However, improvement of the performance of the conventional regenerative fluid machine has mainly focused on improving shapes of the vanes 12 and the impeller grooves 14 in the impeller 10. For this reason, it is increasingly difficult to fabricate the shape of the impeller 10, and manufacturing costs are increased.

In addition, in the conventional regenerative fluid machine, since the impeller 10 is designed without properly conducting research on the flow characteristics of the fluid, the improvement of the performance of the regenerative fluid machine is limited.

DISCLOSURE

Technical Problem

Accordingly, the present invention has been made keeping in mind the above problems occurring in the prior art, and an object of the present invention is to provide a regenerative fluid machine having guide vanes on a flow channel wall, in which an inflow angle of the fluid introduced into impeller grooves is changed to be able to reduce energy loss caused by eddies generated in the impeller grooves.

Technical Solution

In order to accomplish the above object(s), the present invention provides a regenerative fluid machine having guide vanes on a flow channel wall. The regenerative fluid machine includes: a circular plate-shaped impeller that has a plurality of vanes radially formed on an outer circumference thereof at regular intervals; casings in which the impeller is housed; and flow channels, each of which has a suction hole and a discharge hole in opposite ends thereof, and which are circumferentially formed in the casings so as to face the vanes. The plurality of guide vanes having an inclination angle θ with respect to a radial direction, protrude in a rotational direction of the impeller throughout an entire wall of the flow channel so that a relative inflow angle β of a fluid introduced into impeller grooves is increased, and an absolute inflow angle α of the fluid is decreased, and the guide vanes are formed at a height of 5 to 30% of a depth of the flow channels.

Here, the guide vanes may be formed on at least ⅓ of an area of the flow channel at regular intervals excluding the suction hole and the discharge hole.

The guide vanes may be formed on at least ⅓ of an area on a bottom surface, an outer surface, and an inner surface of the flow channels.

Further, the inclined angle θ of the guide vanes may range from 30 to 80°.

The guide vanes may be formed at the height of 5 to 30% of a depth of the flow channel.

In addition, the interval between the guide vanes may be the same as that between the vanes.

The guide vanes according to the present invention may have a quadrangular cross section. Alternatively, the guide vanes may have a triangular, semicircular, or elliptical cross section.

Advantageous Effects

The regenerative fluid machine according to the present invention has an advantage in that performance of the regenerative fluid machine can be improved without changing the shape of an impeller. For example, there is an advantage in that manufacturing costs are reduced compared to when the shapes of the impeller vanes are inclined like a shape of a propeller. In addition, a wall of each flow channel includes guide vanes for guiding a flow of a fluid to change an inflow angle of the fluid introduced into impeller grooves. Thereby, energy loss caused by eddies can be minimized, and pumping efficiency can be improved.

In the regenerative fluid machine according to the present invention, the guide vanes have a cross-sectional shape such as a quadrangle, semicircular, or elliptical shape and protrude from the wall of the flow channel. Accordingly, it is easy to form the guide vanes and the flow channels at the same time using a method such as casting or forging when a casing is manufactured. In other words, there is an advantage in that the performance of the regenerative fluid machine can be improved without an additional expense for the guide vanes.

In addition, the present invention has an advantage in which the problems of the conventional regenerative fluid machine with low pumping efficiency are solved, and thus the range of industrial application can be expanded.

Other objects, specific merits, and novel features of the present invention will become more obvious based on the following detailed description and preferred embodiments related to the accompanying drawings.

BEST MODE

Figure 1:
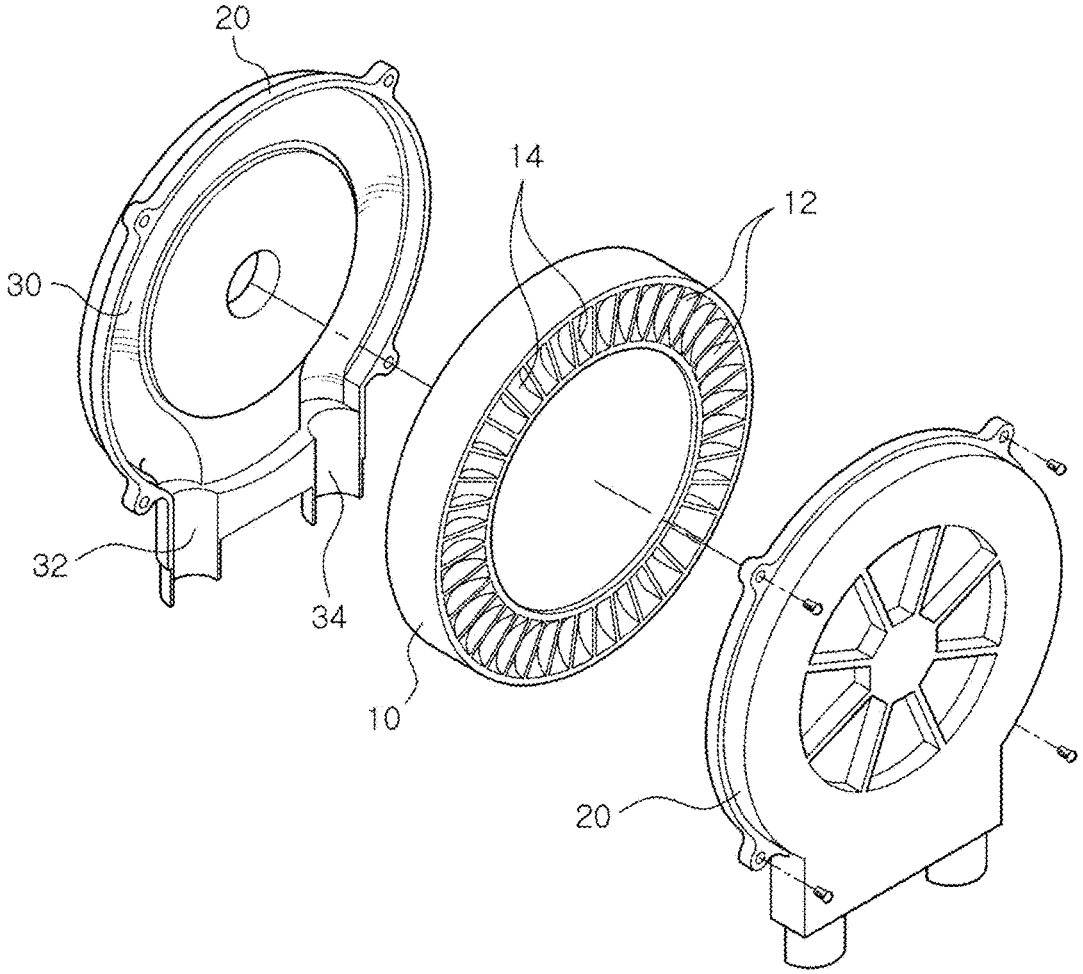
FIG. 1 is an exploded perspective view illustrating an example of a conventional ring blower.

Hereinafter, preferred embodiments of the present invention will be described in further detail with reference to the accompanying drawings. The same components will be denoted by the same reference numerals although they are shown in different drawings.

First, a configuration of a regenerative fluid machine according to the present invention having guide vanes formed on a flow channel wall will be described.

Before a description is made, it should be noted in advance that the present invention can be applied to various regenerative fluid machines such as an air blower and a regenerative pump including a ring blower. In addition, since a configuration and operational effects of the impeller 10 according to the present invention are the same as those in the description of the Background Art, a repeated description will be omitted, and a related description will be made with reference to FIGS. 1 and 2.

Figure 2:
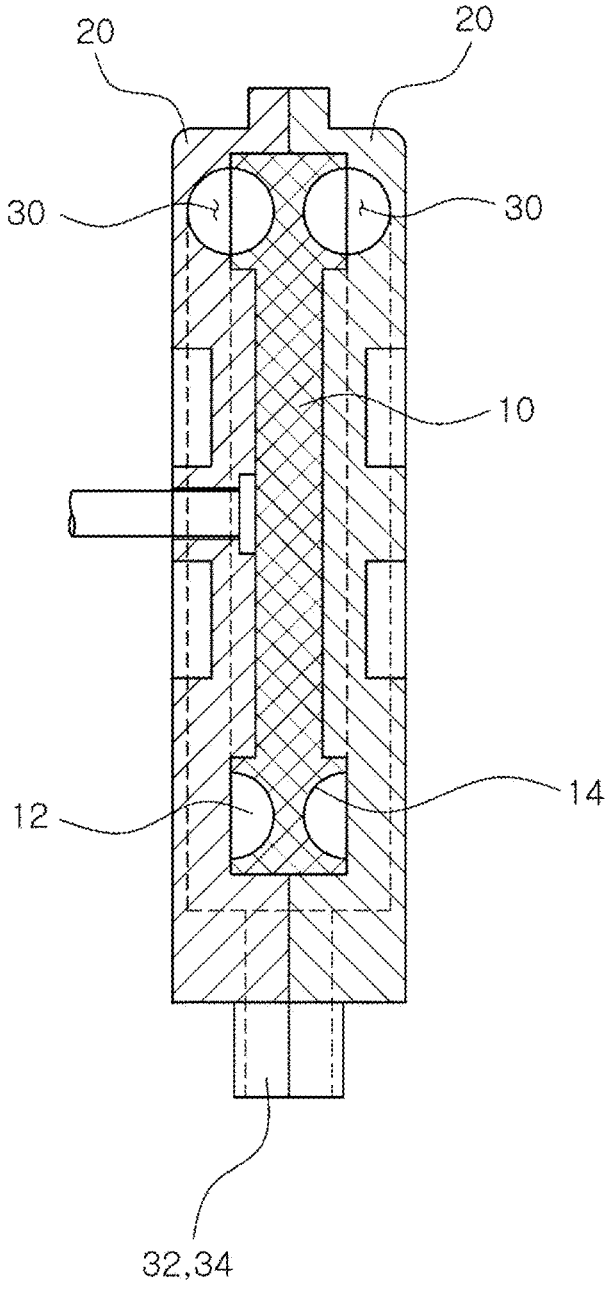
FIG. 2 is a cross-sectional view illustrating an assembled state of the ring blower of FIG. 1.

An impeller 10 has a circular plate shape, and includes a plurality of vanes 12 that are radially formed on an outer circumference or circumferences of one or both faces thereof at regular intervals. In addition, impeller grooves 14 are formed between the vanes 12. As shown in FIGS. 1 and 2, the impeller grooves 14 have a semicircular cross-sectional shape. Alternatively, the impeller grooves 14 may have an elliptical or quadrangle shape in consideration of a flow characteristic of the fluid, or a modified shape with a different cross-sectional area.

The impeller 10 is provided in casings 20 in which flow channels 30 are formed so as to correspond to the impeller grooves 14. The regenerative fluid machine having such a structure is called a side channel type. The impeller 10 of the side channel type may have only the vanes 12 without the impeller grooves 14. On the other hand, although not shown in the drawings, there is an open channel type in which the impeller 10 has an open radial end and is provided with the flow channels 30 along an outer circumference thereof. It should be noted in advance that the regenerative fluid machine according to the present invention can be applied to the open channel type in addition to the side channel type.

Figure 4:
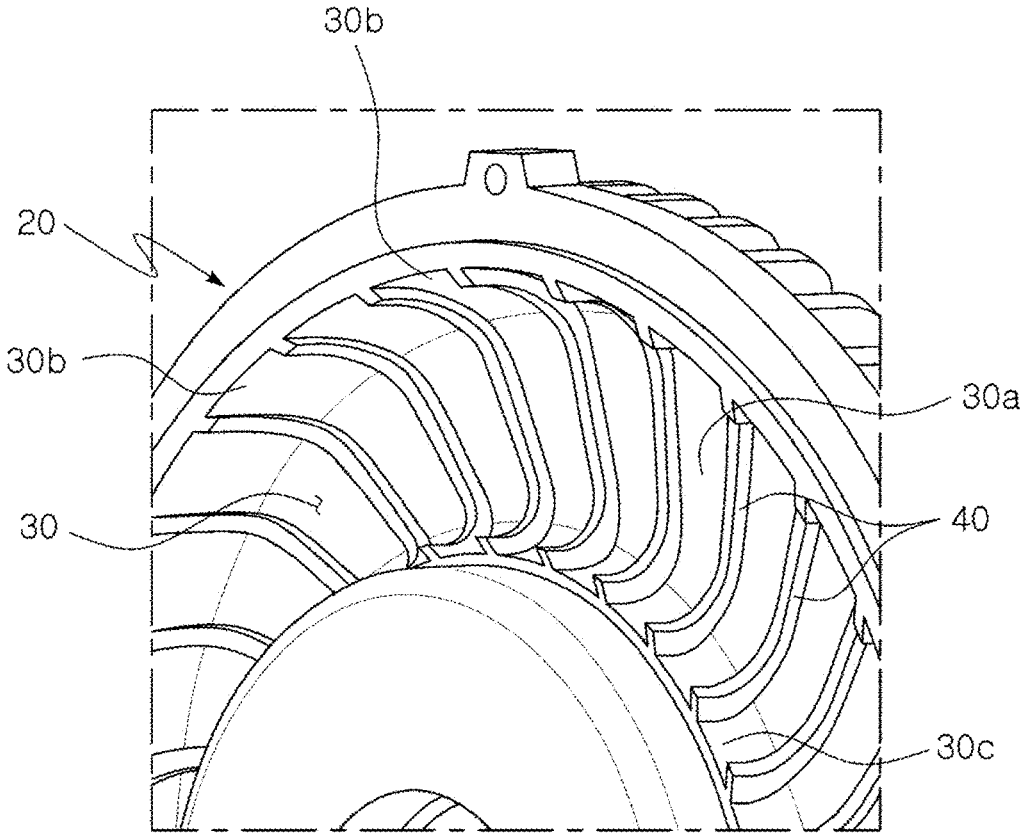
FIG. 4 is a perspective view illustrating a part of casings of a regenerative fluid machine according to an embodiment of the present invention.
Figure 5:
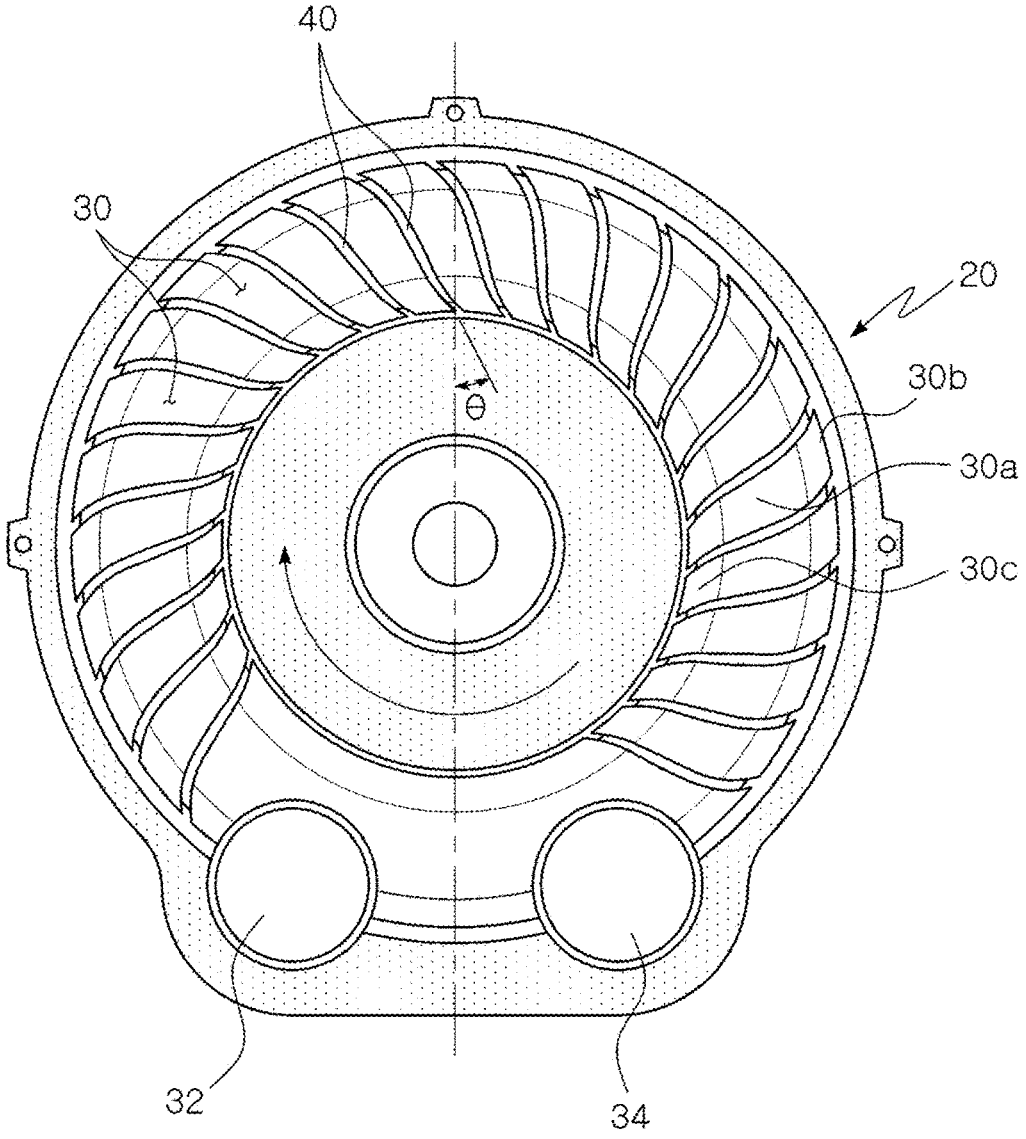
FIG. 5 is a front view of FIG. 4.

FIG. 4 is a perspective view illustrating a part of the casings of the regenerative fluid machine according to the embodiment of the present invention, and FIG. 5 is a front view of FIG. 4. As shown in FIGS. 4 and 5, the flow channels 30 are formed inside the casings 20 in a ring shape, and face the vanes 12 and the impeller grooves 14 in the impeller 10. Further, both ends of each flow channel 30 are provided with a suction hole 32 and a discharge hole 34, respectively. The suction hole 32 and the discharge hole 34 are formed in each casing 20 in an axial or radial direction of the impeller 10.

It is preferable that the flow channels 30 have a cross section corresponding to the impeller grooves 14. According to the embodiment, as shown in FIG. 4, the flow channels 30 have a U-shaped cross section formed by a wall, i.e., a bottom surface 30*a*, an outer surface 30*b*, and an inner surface 30*c*.

A plurality of guide vanes 40 function to change an inflow angle of the fluid introduced into the impeller grooves 14. As in FIG. 4, the plurality of guide vanes 40 has a long strip shape with a rectangular cross section, and protrude along the wall, i.e., the bottom surface 30*a*, the outer surface 30*b*, and the inner surface 30*c* from a vicinity of the suction hole 32 of each flow channel 30 to a vicinity of the discharge hole 34 of each flow channel 30 at regular intervals. In this case, it is preferable that the guide vanes 40 are integrally formed with each casing 20, and are thereby formed with each flow channel 30 at the same time when each casing 20 is manufactured.

The guide vanes 40 may be designed to have various cross sections such as a trapezoid, a triangle, a semicircle, or an ellipse in consideration of flow resistance of the fluid In addition, it is preferable that the guide vanes 40 are formed at a height of about 5 to 30% of a depth of each flow channel 30 according to the flow characteristic of the fluid. This is intended to maintain a function of guiding the fluid to the impeller grooves 14 (which will be described below) without interfering with the flow of the fluid in the flow channel 30.

On the other hand, as shown in FIG. 5, it is preferable that the guide vanes 40 have an inclined angle θ of about 30 to 80° with respect to a radial direction of the casing 20 according to the flow characteristic of the fluid. In FIG. 5, the plurality of guide vanes 40 are inclined in a counter-clockwise direction. In this case, the impeller 10 rotates clockwise as denoted by an arrow in FIG. 5. Furthermore, an interval between the guide vanes 40 may be increased or decreased according to the flow characteristic of the fluid. However, most preferably, such an interval is the same as that between the above-mentioned vanes 12 of the impeller 10.

Figure 6A:
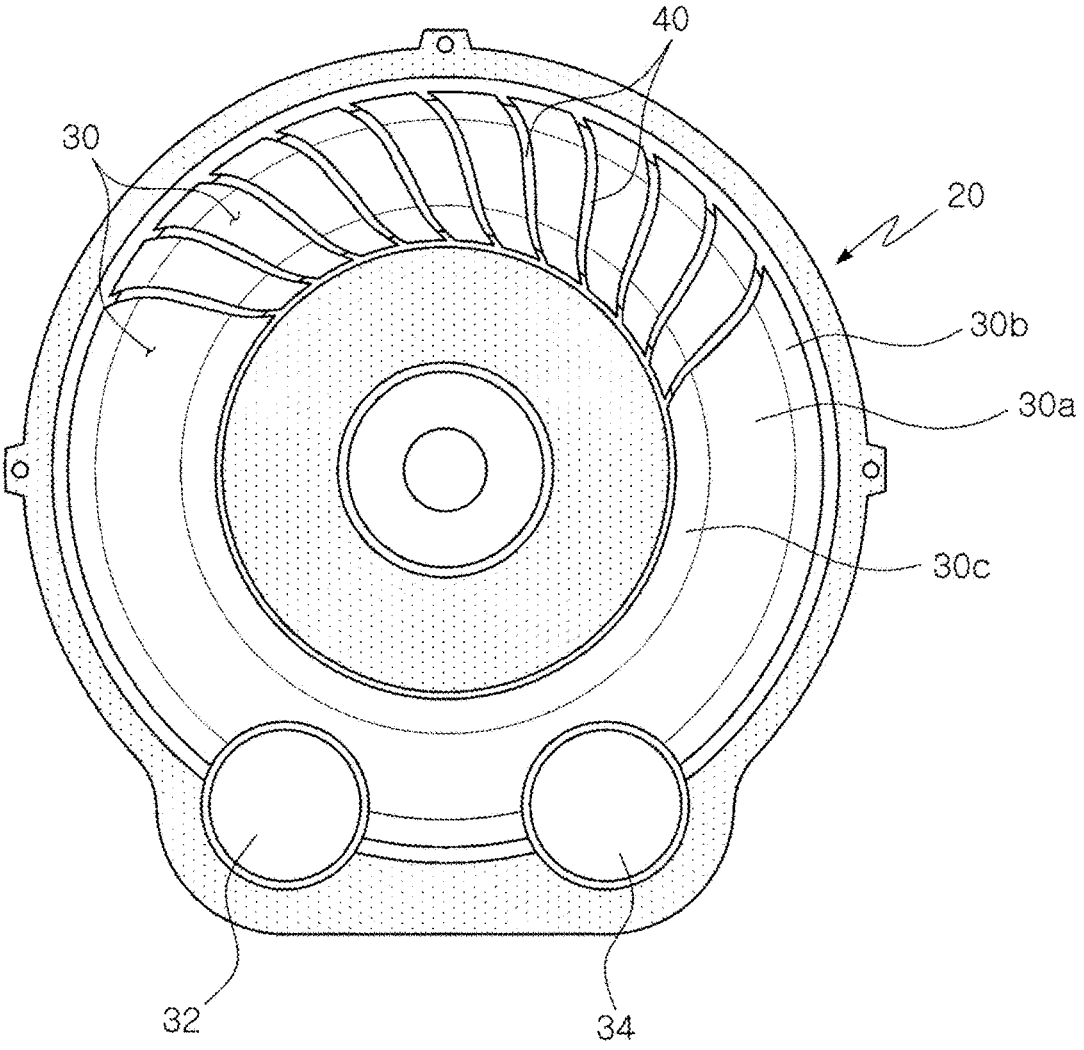
FIGS. 6*a* and 6*b* are front views illustrating modifications of guide vanes according to the present invention.
Figure 6B:
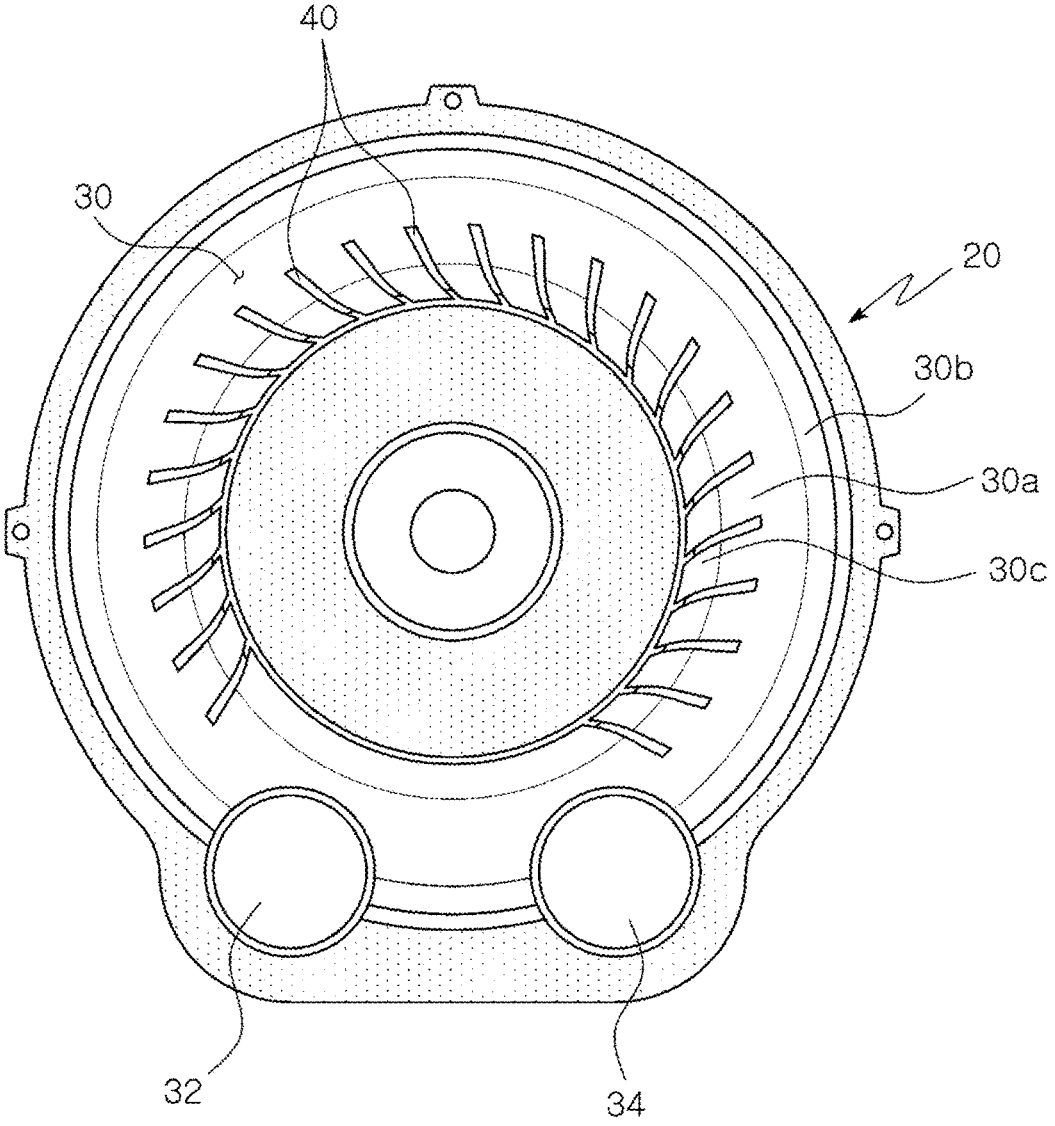

FIGS. 6*a* and 6*b* are modifications of guide vanes according to the present invention. As in FIG. 6*a*, the guide vanes 40 may be formed on at least ⅓ of an area of the flow channel 30 at regular intervals, excluding the suction hole 32 and the discharge hole 34. The guide vanes 40 are unnecessary on areas adjacent to the suction hole 32 and the discharge hole 34, because the guide vanes 40 function to change the inflow angle of the fluid introduced into the impeller grooves 14. Even when the guide vanes 40 are formed only on a center area of the flow channel 30, there is no great difference in the effect of changing the inflow angle of the fluid, because the flow is stabilized on the center area of the flow channel 30.

In addition, as shown in FIG. 6*b*, the guide vanes 40 according to the present invention may be formed only on some areas of the bottom surface 30*a* and the inner surface 30*c* of the flow channel 30. Similarly, the guide vanes 40 may be formed only on at least ⅓ of the area of the bottom surface 30*a*, the outer surface 30*b*, and the inner surface 30*c* of the flow channel 30. In this case, the guide vanes 40 may have a continuous or discontinuous shape in a longitudinal direction.

Hereinafter, an operational effect of the regenerative fluid machine having the guide vanes on the flow channel wall according to the present invention with the above-mentioned configuration will be described.

Figure 3:
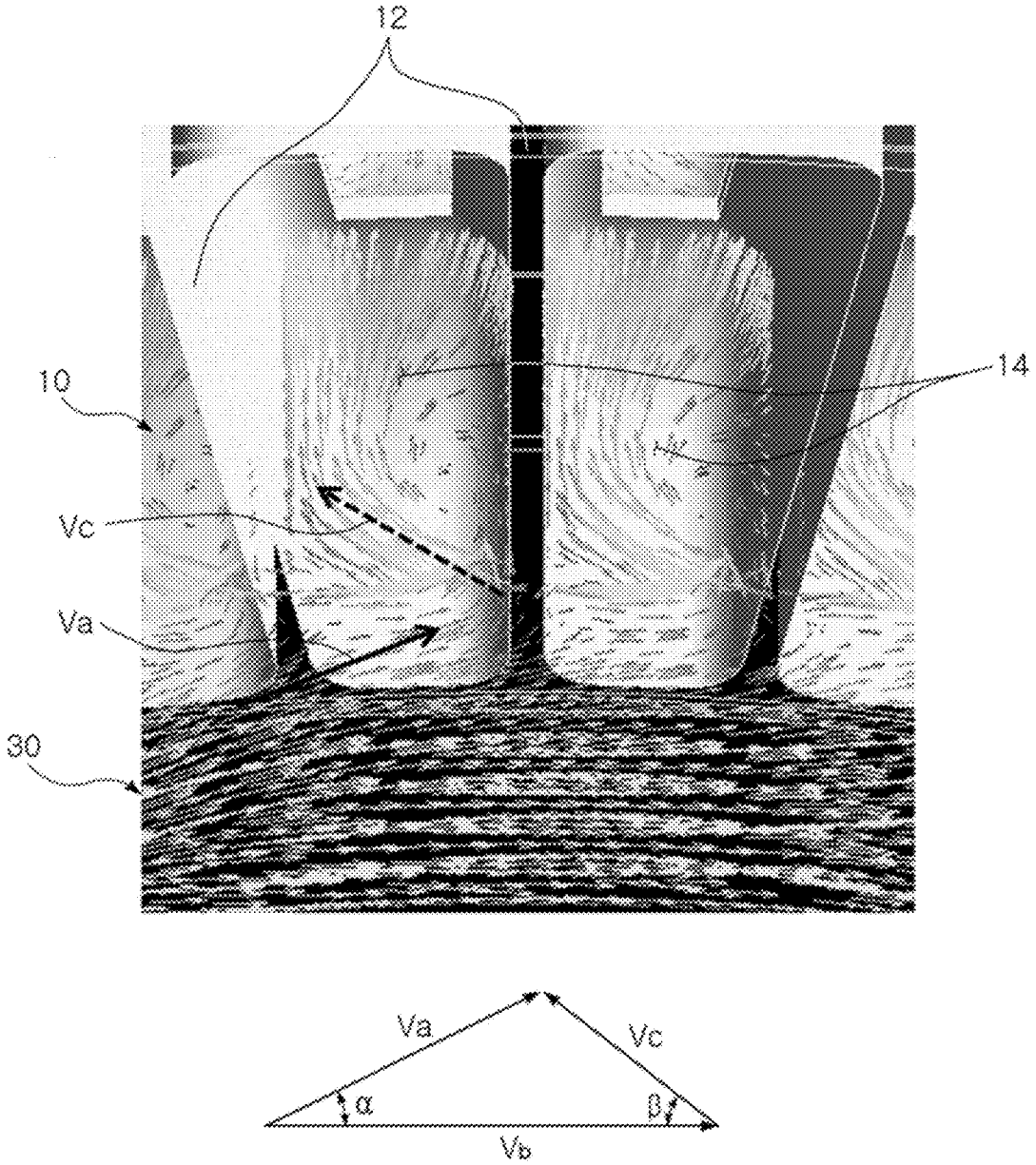
FIG. 3 is a diagram for describing a flow characteristic of a fluid in flow channels and impeller grooves.

First, a circulation flow of the fluid in the impeller grooves 14 will be described with reference to FIG. 3. As described above, as the impeller 10 rotates clockwise, the fluid is introduced from the flow channels 30 into the impeller grooves 14, flows outside the impeller grooves 14, and is introduced into the flow channels 30 again.

Next, the fluid introduced from the outside of the impeller grooves 14 into the flow channels 30 flows inside the impeller grooves 14 along left sides of the guide vanes 40 illustrated in FIG. 5, and is introduced into the flow channels 30 again. Such a flow is repeatedly formed in the plurality of impeller grooves 14 and on the plurality of guide vanes 40. Here, the guide vanes 40 function to guide the flow of the fluid to the flow channels 30, thereby reducing an absolute inflow angle α of the fluid introduced into the impeller grooves 14.

Figure 7:
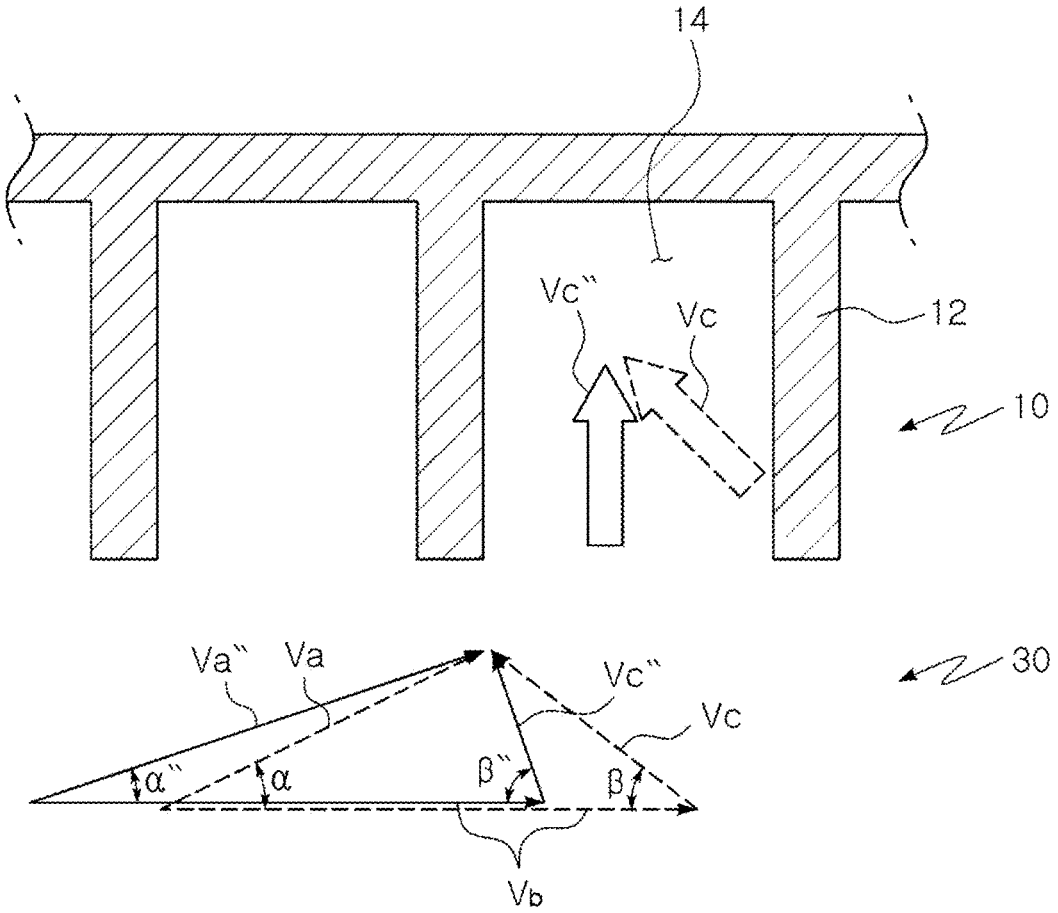
FIG. 7 is a schematic view for describing a flow characteristic in the regenerative fluid machine according to the present invention.

FIG. 7 is a schematic view for describing a flow characteristic in the regenerative fluid machine according to the present invention. In FIG. 7, arrows indicated by a broken line represent velocities of the fluid and the impeller in the conventional regenerative fluid machine, and arrows indicated by a solid line represent velocities of the fluid and the impeller in the present invention.

In the conventional regenerative fluid machine, an absolute velocity Va and a relative velocity Vc of the fluid introduced into the impeller grooves 14 have an absolute inflow angle α and a relative inflow angle β with respect to a velocity Vb of the impeller 10.

In the regenerative fluid machine according to the present invention, the wall of the flow channel 30 is provided with the plurality of guide vanes 40, and thereby the absolute inflow angle α of the fluid is decreased to an angle α". As a result, the absolute velocity Va increases to an absolute velocity Va". In this case, since the velocity Vb of the impeller is constant, and the absolute velocity Va increases to the absolute velocity Va", the relative velocity Vc of the fluid introduced into the impeller grooves 14 decreases to a relative velocity Vc", and the relative inflow angle β increases to a relative inflow angle β".

As a result, the relative inflow angle β" increases to allow the fluid to be introduced into the impeller grooves 14 so as to be approximately parallel to the vanes 12. Thereby, the energy loss caused by eddies generated within the impeller grooves 14 can be minimized.

Figure 8:
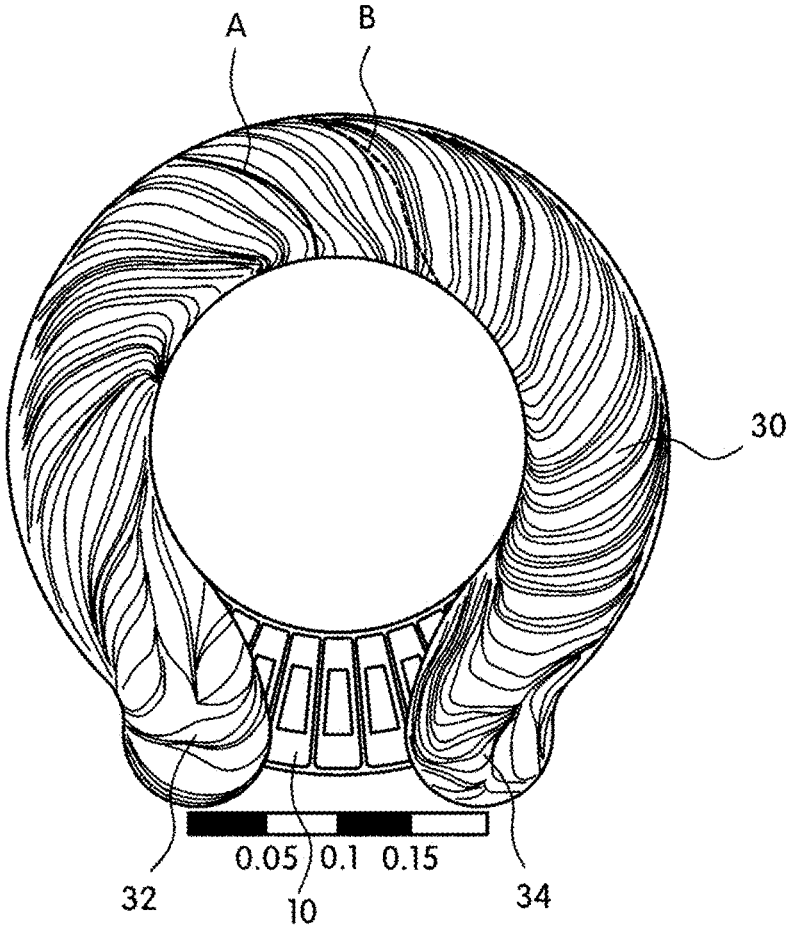
FIG. 8 is a diagram for describing an improved streamline in the flow channels of the present invention.

FIG. 8 is a diagram for describing an improved streamline in the flow channel of the present invention. Referring to FIG. 8, a streamline A in an area of the flow channel 30 of the conventional regenerative fluid machine is represented. In other words, when the guide vanes 40 according to the present invention are not employed, the streamline A indicated by a solid line as shown in FIG. 8 has an inwardly curved shape at a radial inner side of the flow channel 30.

However, the regenerative fluid machine according to the present invention is provided with the plurality of guide vanes 40. A streamline B indicated by a broken line is provided. In other words, the flow is outwardly curved at the radial inner side of the flow channel 30, thereby having the streamline B along the shape of the guide vanes 40. The guide vanes 40 guide the flow of the fluid in the flow channel 30, and thereby the streamline B is formed, and the absolute inflow angle α of the fluid introduced into the impeller grooves 14 is decreased.

While the present invention has been described with reference to the embodiments and accompanying drawings, it should be interpreted that terms or words used in the description and claims should not be interpreted as being limited merely to common and dictionary meanings but should be interpreted as having meanings and concepts which are defined within the technical scope of the present invention. Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A regenerative fluid machine having guide vanes on a flow channel wall comprising:

a circular plate-shaped impeller (10) that has a plurality of vanes (12) radially formed on an outer circumference thereof at regular intervals;

casings (20) in which the impeller (10) is housed; and flow channels (30), each of which has a suction hole (32) and a discharge hole (34) in opposite ends thereof, and which are circumferentially formed in the casings so as to face the vanes (10), wherein the plurality of guide vanes (40) throughout an entire wall (30*a*, 30*b*, 30*c*) of each flow channel (30), wherein the plurality of guide vanes (40) are inclined in a direction opposite a rotational direction of the impeller (10) with an inclined angle (θ), wherein an inner peripheral portion of each of the plurality of guide vanes is curved outwardly toward the rotational direction of the impeller, and wherein the plurality of guide vanes (40) are configured to increase a relative inflow angle (β) of a fluid introduced into impeller grooves (14), and decrease an absolute inflow angle (α) of the fluid, and wherein the guide vanes (40) are formed at a height of 5 to 30% of a depth of the flow channel (30) and formed on at least ⅓ of an area of the flow channel (30) excluding the suction hole (32) and the discharge hole (34).

2. The regenerative fluid machine of claim 1, wherein the inclined angle (θ) of the guide vanes (40) ranges from 30 to 80°.

3. The regenerative fluid machine of claim 1, wherein the interval between the guide vanes (40) is the same as that between the vanes (12).

* * * * *